US008984847B1

(12) United States Patent
Nguyen et al.

(10) Patent No.: US 8,984,847 B1
(45) Date of Patent: Mar. 24, 2015

(54) LINER SEALING GARBAGE CONTAINER

(76) Inventors: Leo Nguyen, Higganum, CT (US); Toan Nguyen, Higganum, CT (US)

( * ) Notice: Subject to any disclaimer, the term of this patent is extended or adjusted under 35 U.S.C. 154(b) by 978 days.

(21) Appl. No.: 13/112,565

(22) Filed: May 20, 2011

(51) Int. Cl.
*B65F 1/06* (2006.01)

(52) U.S. Cl.
USPC ..... 53/567; 220/908.1

(58) Field of Classification Search
CPC .. B65F 1/062; B65F 1/1426; B65F 2240/132; B65F 2210/1675; B65F 2210/167; B65B 67/1277; B65B 9/15
USPC ..... 53/567, 459, 370, 576, 577, 53/138.1–138.4; 220/495.07, 495.08, 220/908.1
See application file for complete search history.

(56) References Cited

U.S. PATENT DOCUMENTS

| | | | | |
|---|---|---|---|---|
| 3,619,822 | A * | 11/1971 | Carmichael, T. | 4/484 |
| 3,826,189 | A | 7/1974 | Grunewald | |
| 4,493,251 | A | 1/1985 | Green | |
| D359,825 | S | 6/1995 | Freedland | |
| 6,126,031 | A | 10/2000 | Reason | |
| 6,370,847 | B1 * | 4/2002 | Jensen et al. | 53/459 |
| 6,516,588 | B2 * | 2/2003 | Jensen et al. | 53/459 |
| 6,612,099 | B2 * | 9/2003 | Stravitz | 53/526 |
| 6,804,930 | B2 * | 10/2004 | Stravitz | 53/211 |
| 6,941,733 | B2 * | 9/2005 | Chomik et al. | 53/576 |
| 7,178,314 | B2 * | 2/2007 | Chomik et al. | 53/459 |
| 7,316,100 | B2 * | 1/2008 | Stravitz et al. | 53/211 |
| 7,395,990 | B1 | 7/2008 | Stevens | |
| 7,708,188 | B2 * | 5/2010 | Stravitz et al. | 232/43.2 |
| 8,613,371 | B2 * | 12/2013 | Rousso et al. | 220/495.07 |
| 8,752,723 | B2 * | 6/2014 | Lucas et al. | 220/495.07 |
| 2005/0183401 | A1 | 8/2005 | Stravitz et al. | |
| 2005/0215961 | A1 | 9/2005 | Romano et al. | |
| 2007/0289967 | A1 | 12/2007 | Pierce et al. | |

* cited by examiner

*Primary Examiner* — Andrew M Tecco

(57) ABSTRACT

A liner sealing garbage container for sealing garbage in a container liner prior to removing the garbage from the container includes a housing having a bottom and a perimeter wall extending upwardly from the bottom. The perimeter wall has an upper edge forming a top opening in the housing. A shelf is coupled to the perimeter wall and extends inwardly from the perimeter wall. The shelf has a central aperture. An annular liner cartridge is positioned on the shelf and a liner extends from the liner cartridge through the central aperture of the shelf. A sealing assembly having opposed sealing members is positioned in the housing. The liner extends between the sealing members and the sealing members are movable to compress and seal the liner between the sealing members.

11 Claims, 6 Drawing Sheets

LINER SEALING GARBAGE CONTAINER

BACKGROUND OF THE DISCLOSURE

Field of the Disclosure

The disclosure relates to garbage disposal devices and more particularly pertains to a new garbage disposal device for sealing garbage in a container liner prior to removing the garbage from the container.

SUMMARY OF THE DISCLOSURE

An embodiment of the disclosure meets the needs presented above by generally comprising a housing having a bottom and a perimeter wall extending upwardly from the bottom. The perimeter wall has an upper edge forming a top opening in the housing. A shelf is coupled to the perimeter wall and extends inwardly from the perimeter wall. The shelf has a central aperture. An annular liner cartridge is positioned on the shelf and a liner extends from the liner cartridge through the central aperture of the shelf. A sealing assembly having opposed sealing members is positioned in the housing. The liner extends between the sealing members and the sealing members are movable to compress and seal the liner between the sealing members.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
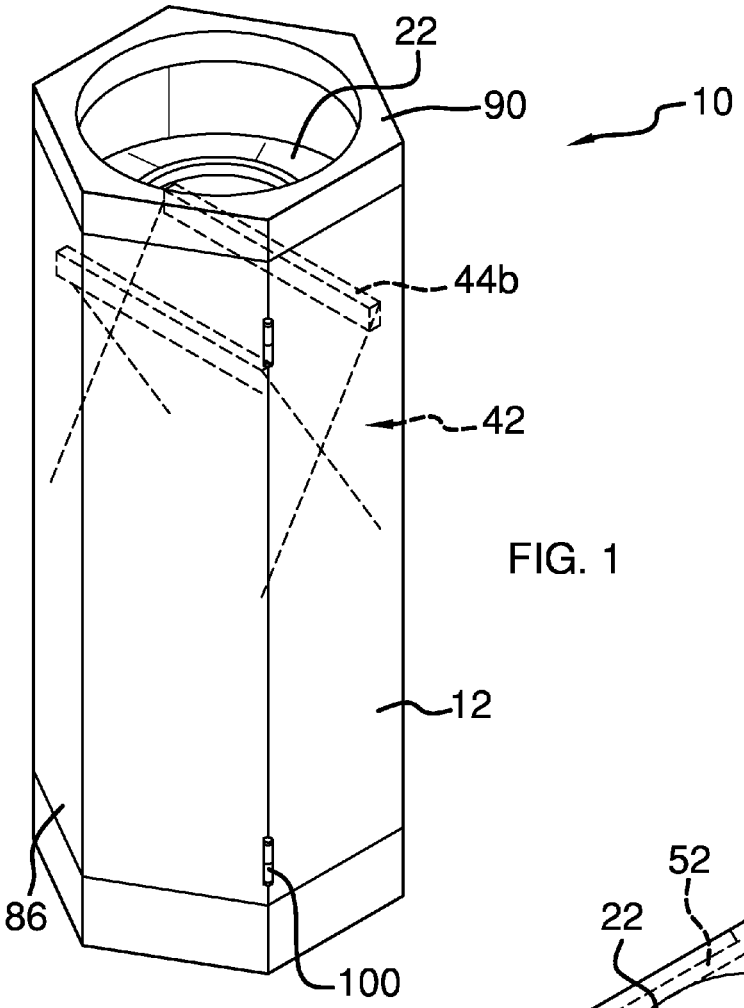
FIG. 1 is a top front side perspective view of a liner sealing garbage container according to an embodiment of the disclosure.
Figure 2:
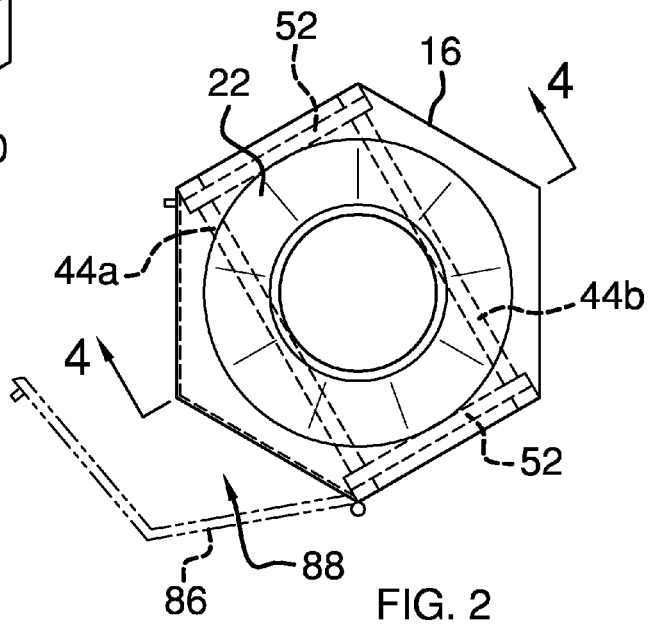
FIG. 2 is a top view of an embodiment of the disclosure.
Figure 3:
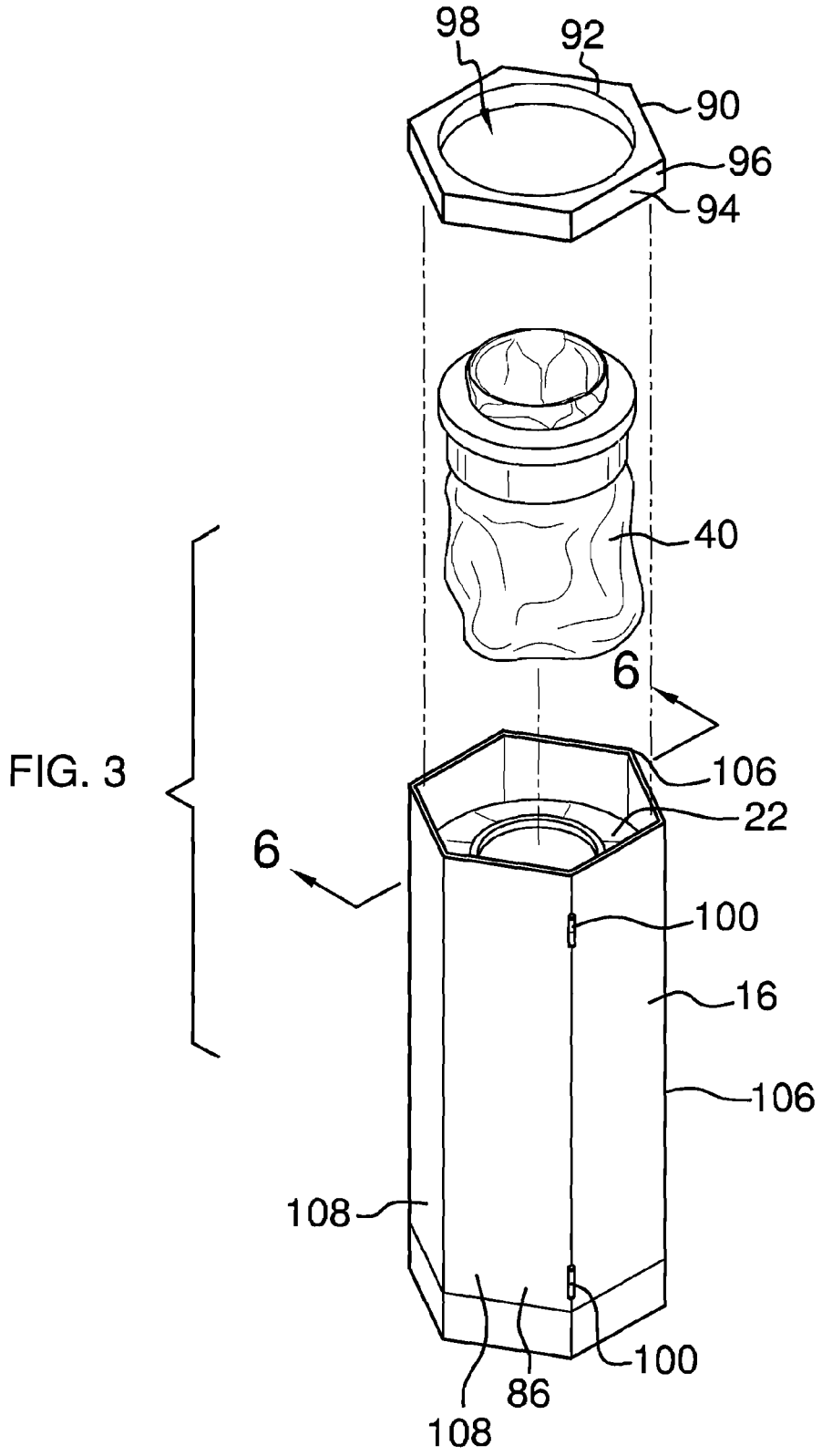
FIG. 3 is a partially exploded view of an embodiment of the disclosure.
Figure 4:
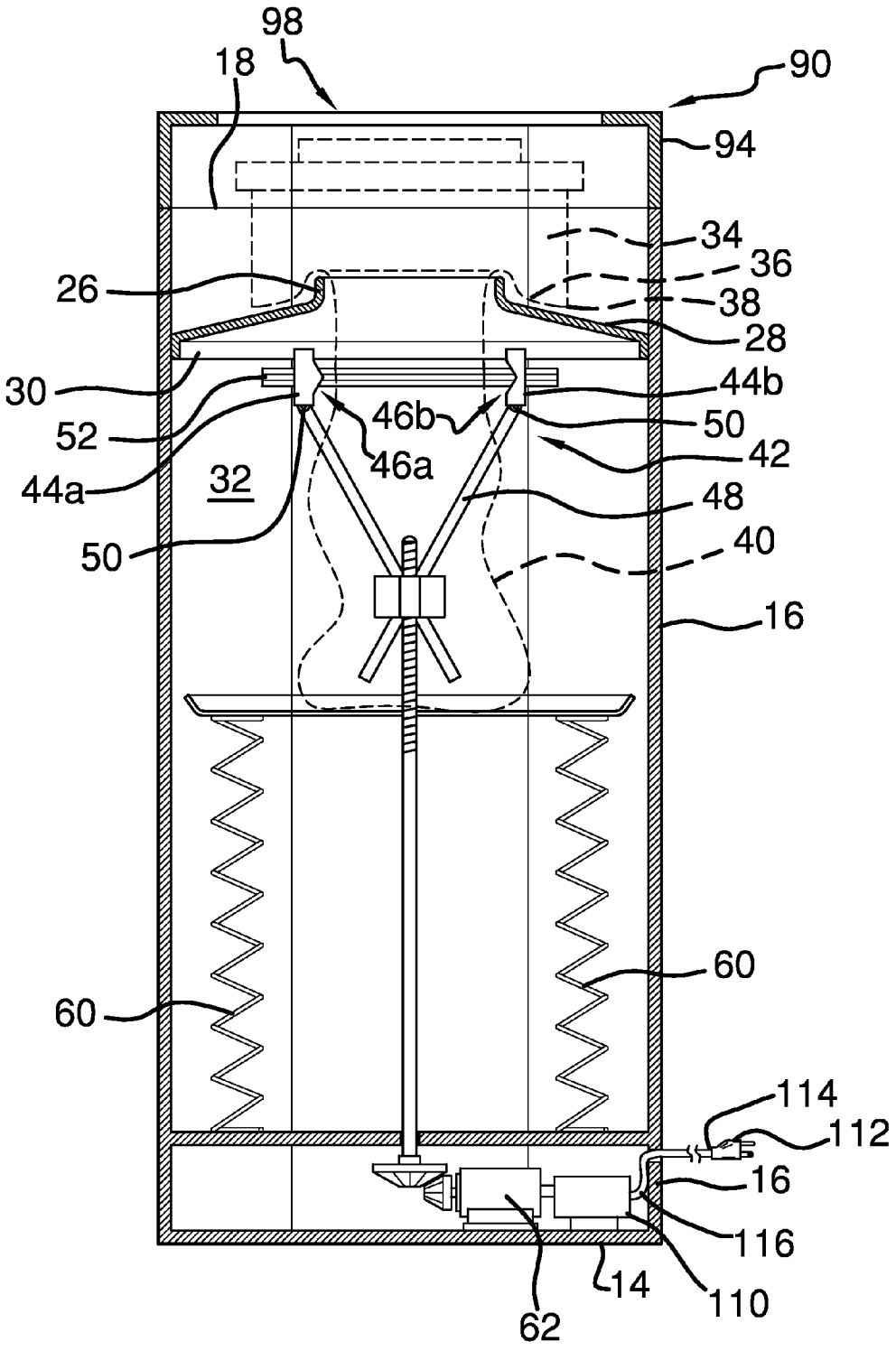
FIG. 4 is a cross-sectional view of an embodiment of the disclosure taken along line 4-4 of FIG. 2.
Figure 5:
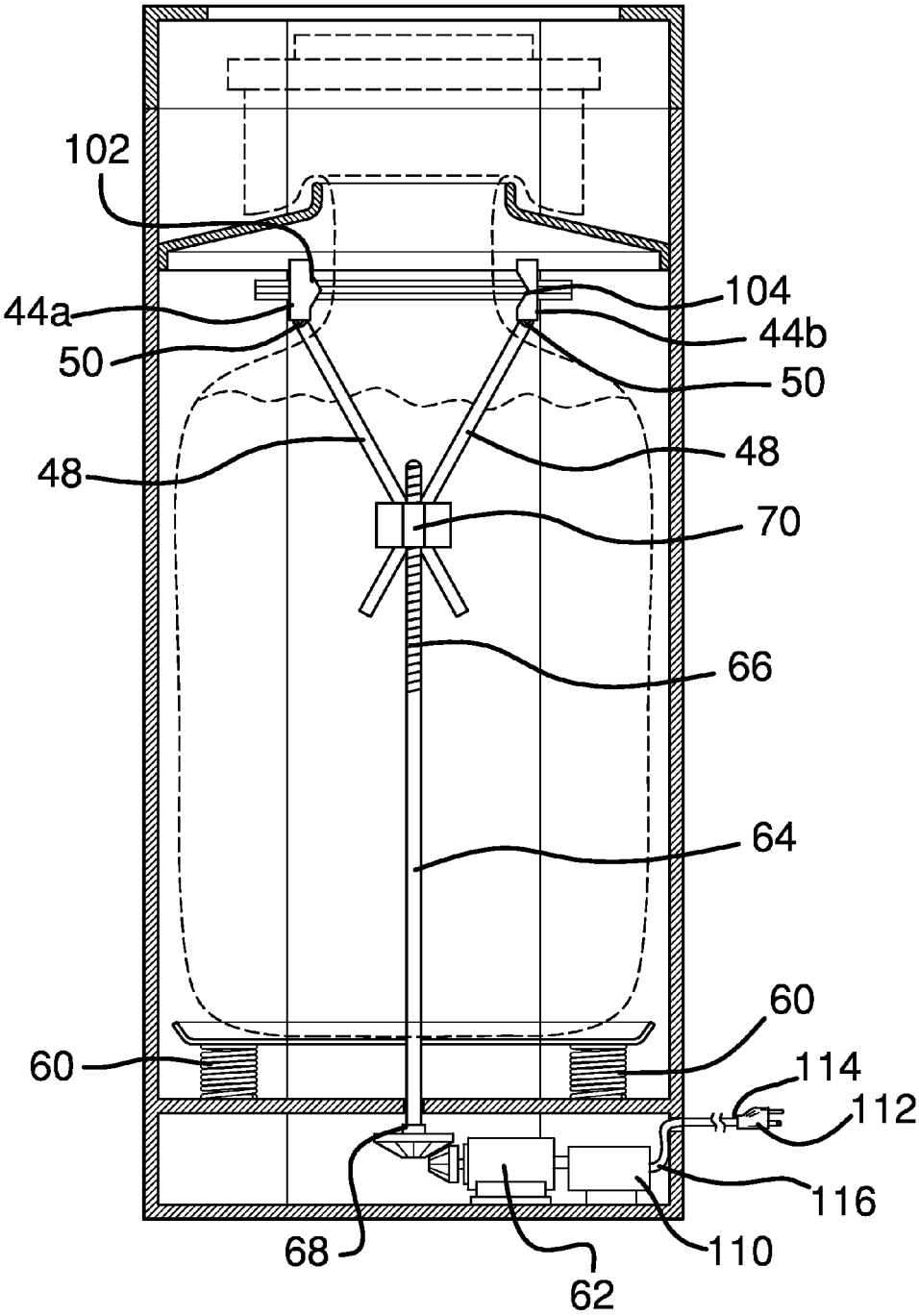
FIG. 5 is a cross-sectional view of an embodiment of the disclosure.
Figure 6:
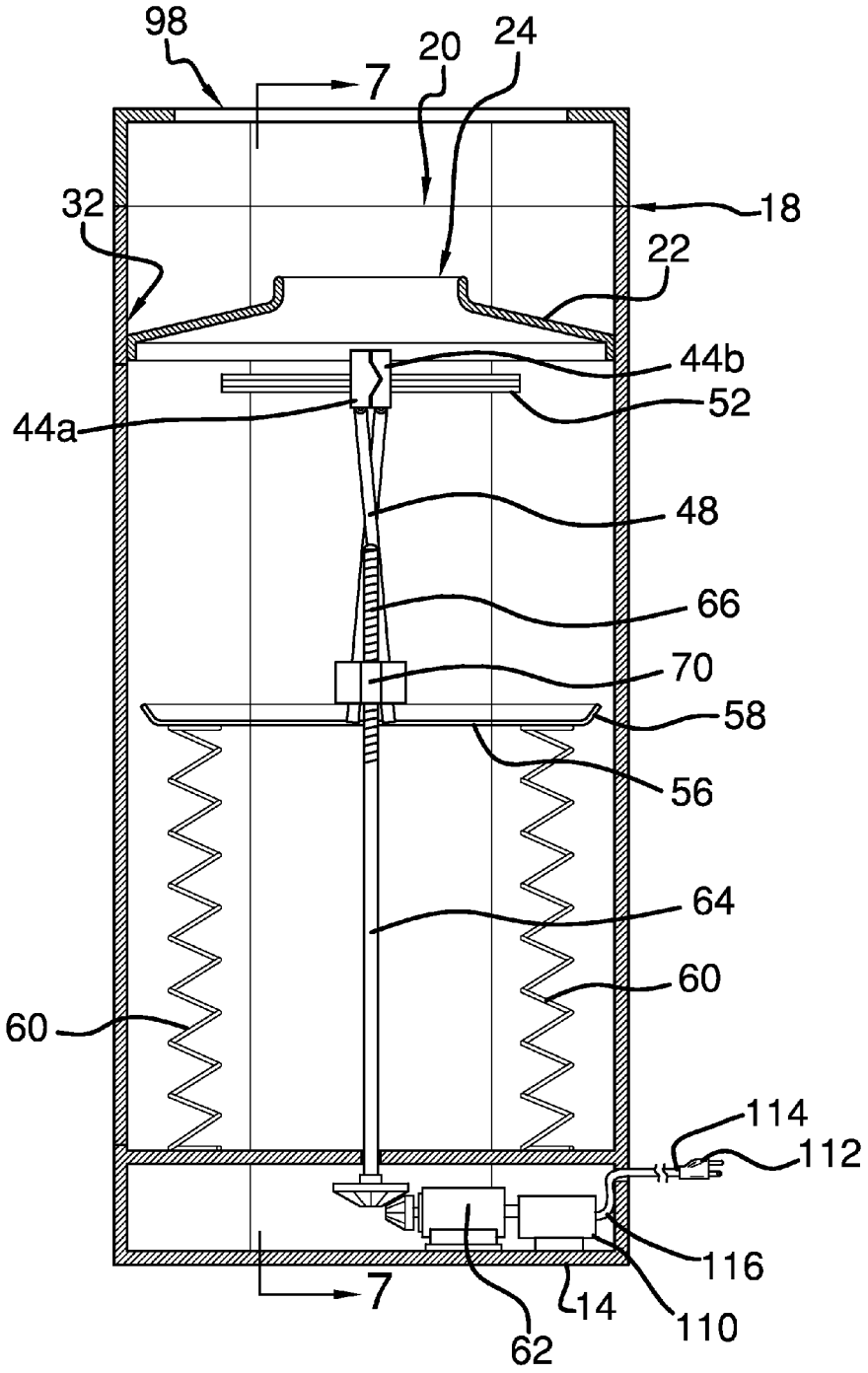
FIG. 6 is a cross-sectional view of an embodiment of the disclosure taken along line 6-6 of FIG. 3.
Figure 7:
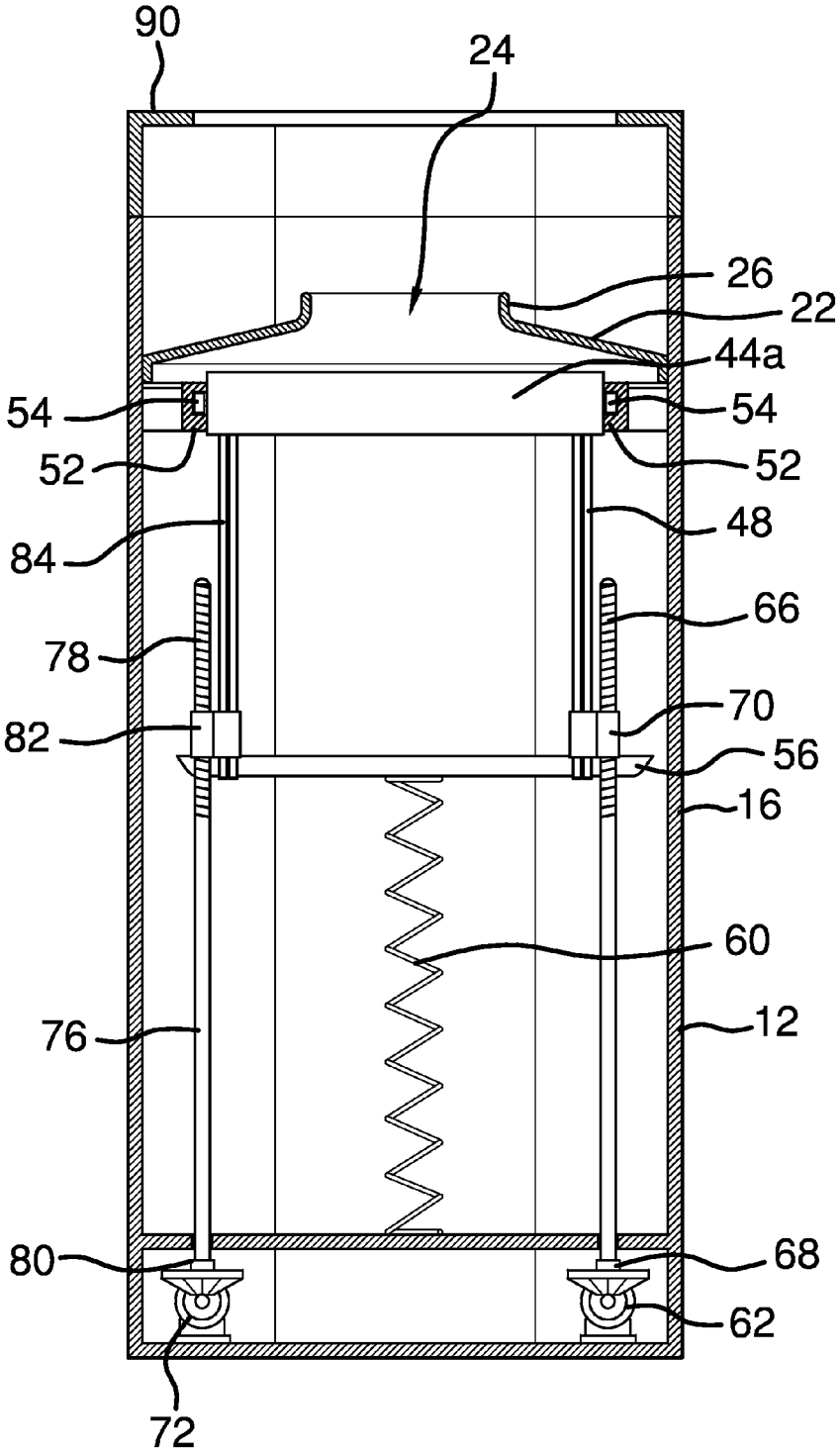
FIG. 7 is a cross-sectional view of an embodiment of the disclosure taken along line 7-7 of FIG. 6.

With reference now to the drawings, and in particular to FIGS. 1 through 7 thereof, a new garbage disposal device embodying the principles and concepts of an embodiment of the disclosure and generally designated by the reference numeral 10 will be described.

As best illustrated in FIGS. 1 through 7, the liner sealing garbage container 10 generally comprises a housing 12 having a bottom 14 and a perimeter wall 16 extending upwardly from the bottom 14. The perimeter wall 16 has an upper edge 18 forming a top opening 20 in the housing 12. A shelf 22 is coupled to the perimeter wall 16. The shelf 22 extends inwardly from the perimeter wall 16. The shelf 22 has a central aperture 24 and a lip 26 extending upwardly around the central aperture 24. The shelf 22 also includes a conical medial portion 28 extending between the lip 26 around the central aperture 24 and a connection band 30 abutting an interior face 32 of the perimeter wall 16. An annular liner cartridge 34 may be positioned on the shelf 22. The cartridge 34 may have a bottom 36 that angles inwardly and upwardly from on outer edge 38 for resting on the conical medial portion 28 of the shelf 22. A liner 40 is compacted in and extends from the liner cartridge 34. The liner 40 is further extendable down through the central aperture 24 of the shelf 22.

A sealing assembly 42 is coupled to the housing 12. The sealing assembly 42 includes a pair of opposed sealing members 44*a*, 44*b*. The liner 40 extends between the sealing members 44*a*, 44*b*. The sealing members 44*a*, 44*b* are movable to compress and seal the liner 40 between the sealing members 44*a*, 44*b*. The sealing members 44*a*, 44*b* have complimentary shaped opposing faces 46*a*, 46*b* to enhance engagement and sealing of the liner 40 between the opposing faces 46*a*, 46*b* of the sealing members 44*a*, 44*b*. A tongue 102 extends from one of the sealing members 44*a*. A groove 104 extends into another of the sealing members 44*b*. The groove 104 is complementary in shape to the tongue 102 and positioned facing the tongue 102. Thus, the tongue 102 is received in the groove 104 when the sealing members 44*a*, 44*b* are moved together to compress and seal the liner 40. The sealing of the liner 40 may be achieved by heat sealing, compression, or another conventional known method of sealing the liner 40.

The sealing assembly 42 further includes a pair of opposed tracks 52 positioned in the housing 12 and coupled to the perimeter wall 16. The sealing assembly 42 further includes a first pair of scissor arms 48 pivotally coupled to each other. The first pair of scissor arms 48 has upper ends 50 coupled to the sealing members 44*a*, 44*b* such that pivoting the first pair of scissor arms 48 moves the sealing members 44*a*, 44*b* in the opposed tracks 52. Each of the sealing members 44*a*, 44*b* has end rollers 54 engaged to the opposed tracks 52 such that the sealing members 44*a*, 44*b* extend between the opposed tracks 52.

A tray 56 may be positioned in the housing 12 beneath the shelf 22. The tray 56 has an upwardly turned outer perimeter edge 58 to assist in holding the liner 40 within the housing 12. A biasing member 60 is positioned below the tray 56 for urging the tray 56 upwardly towards the shelf 22. Thus, the tray 56 is configured to support varying amounts of garbage disposed into the liner 40 through the central aperture 24 of the shelf 22. As the weight of the disposed garbage increases, the tray 56 is biased downwardly supported on the biasing member 60. Multiple biasing members 60 may be arranged to bias the tray 56 upwardly as desired.

A first motor 62 and transformer 110 are positioned in the housing 12. A power plug 112 is electronically coupled to the transformer and positioned at the end 114 of a power cord 116 extending out of the housing 12. A first screw rod 64 is also positioned in the housing 12. The first screw rod 64 has a threaded upper end 66 and a lower end 68 operationally engaged to the first motor 62 to rotate the first screw rod 64. A first threaded collar 70 is engaged to the threaded upper end 66 of the first screw rod 64 and the first pair of scissor arms 48 so that rotation of the first screw rod 64 urges the first threaded collar 70 to pivot, the first pair of scissor arms 48. A second motor 72 may also be positioned in the housing 12. A second screw rod 76 is positioned in the housing 12 having a threaded upper end 78 and a lower end 80 that is operationally engaged to the second motor 72 to rotate the second screw rod 76. A second threaded collar 82 is engaged to the threaded upper end 78 of the second screw rod 76 and a second pair of scissor arms 84. The second pair of scissor arms 84 is spaced from the first scissor arms 48. Rotation of the second screw rod 76 urges the second threaded collar 82 to pivot the second pair of scissor arms 84. A power source for the first motor 62 and second motor 72 may also be operationally coupled to the sealing members 44 to permit heat sealing of the liner 40. The first motor 62 and second motor 72 may be activated by a conventional trigger mechanism such as a power button or switch.

A door 86 is pivotally coupled to the perimeter wall 16 by hinges 100. The perimeter wall 16 may have a plurality of corners 106 forming a polygonal transverse cross-sectional shape such as a hexagon. The hinges may be positioned along one of the corners 106. The perimeter wall 16 has an opening 88 that may extend from between corners 106 of the perimeter wall 16. The door 86 may also be structured to include planar sections 108 for selectively covering the opening 88 in a manner that provides an appearance consistent with the polygonal transverse cross-sectional shape of the perimeter wall 16. The opening 88 is configured to facilitate removal of the filled and sealed liner 40 from the housing 12.

A cover 90 has a planar top portion 92 and a sidewall 94 extending from a perimeter edge 96 of the top portion 92. The top portion 92 has a central hole 98. The hole 98 is aligned with the central aperture 24 when the cover 90 is positioned on the housing 12 such that the liner 40 is configured for receiving refuse deposited into the liner 40 through the hole 98 and the central aperture 24.

In use, the liner cartridge 34 is positioned on the shelf 22 and the liner 40 is positioned to extend down into the housing 12. The liner 40 may be tied off or sealed to form the base of a refuse bag in the housing 12. Refuse is inserted into the liner 18 and sealed by activation of the first motor 62 and second motor 72 to compress the liner 40 between the sealing members 44*a*, 44*b*. The refuse is supported by the biased tray 56 to facilitate sealing the liner 44*a*, 44*b* adjacent to the contained refuse to minimize waste of the liner 40. The door 86 is opened to remove the sealed liner 40 as desired. The liner 40 may be sealed frequently or infrequently as desired without wasting the liner 40. The liner 40 may also be periodically sealed to inhibit odors.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A garbage container assembly comprising:

a housing having a bottom, a perimeter wall extending upwardly from said bottom, said perimeter wall having an upper edge forming a top opening in said housing;

a shelf coupled to said perimeter wall, said shelf extending inwardly from said perimeter wall, said shelf having a central aperture;

an annular liner cartridge positioned on said shelf, a liner extending from said liner cartridge and through said central aperture of said shelf;

a pair of opposed tracks positioned in said housing and coupled to said perimeter wall; and a sealing assembly coupled to said housing, said sealing assembly having opposed sealing members, said liner extending between said sealing members, said sealing members being movable to compress and seal said liner between said sealing members, each of said sealing members having end rollers engaged to said opposed tracks such that said sealing members extend between said opposed tracks, and wherein said sealing assembly further comprises a first pair of scissor arms pivotally coupled to each other, said first pair of scissor arms having upper ends coupled to said sealing members whereby pivoting of said first pair of scissor arms moves said sealing members in said opposed tracks, a first motor positioned in said housing, a first screw rod positioned in said housing, said first screw rod having a threaded upper end and a lower end operationally engaged to said first motor to rotate said first screw rod, and a first threaded collar, said first threaded collar being engaged to said threaded upper end of said first screw rod and said first pair of scissor arms whereby rotation of said screw rod urges said first threaded collar to pivot said first pair of scissor arms.

2. The assembly of claim 1, further comprising:

a tray positioned in said housing beneath said shelf; and a biasing member positioned below said tray for urging said tray upwardly towards said shelf whereby said tray is configured to support garbage disposed into said liner through said central aperture of said shelf.

3. The assembly of claim 2, wherein said tray includes an upwardly turned outer perimeter edge.

4. The assembly of claim 1, wherein said sealing assembly further comprises:

a second motor positioned in said housing;

a second screw rod positioned in said housing, said second screw rod having a threaded upper end and a lower end operationally engaged to said second motor to rotate said second screw rod; and a second threaded collar, said second threaded collar being engaged to said threaded upper end of said second screw rod and a second pair of scissor arms whereby rotation of said screw rod urges said second threaded collar to pivot said second pair of scissor arms.

5. The assembly of claim 1, wherein said shelf further includes a lip extending upwardly around said central aperture.

6. The assembly of claim 1, wherein said pair of sealing members has complimentary shaped opposing faces to enhance engagement and sealing of said liner between said opposing faces of said sealing members.

7. The assembly of claim 1, further comprising:

a door pivotally coupled to said perimeter wall; and said perimeter wall having an opening, said door selectively covering said opening.

8. The assembly of claim 1, further including a cover having a planar top portion and a sidewall extending from a perimeter edge of said top portion, said top portion having a central hole, wherein said hole is aligned with said central aperture when said cover is positioned on said housing such that said liner is configured for receiving refuse deposited into said liner through said hole and said central aperture.

9. The assembly of claim 1, wherein further comprising:

a tongue extending from one of said sealing members; and a groove extending into another of said sealing members, said groove being complementary in shape to said tongue and positioned facing said tongue whereby said tongue is received in said groove when said sealing members are moved together to compress and seal said liner.

10. The assembly of claim 1, wherein said shelf includes a conical medial portion extending between a lip around said central aperture and a connection band abutting an interior face of said perimeter wall.

11. A garbage container assembly comprising:

a housing having a bottom, a perimeter wall extending upwardly from said bottom, said perimeter wall having an upper edge forming a top opening in said housing;

a shelf coupled to said perimeter wall, said shelf extending inwardly from said perimeter wall, said shelf having a central aperture and a lip extending upwardly from said shelf around said central aperture, said shelf including a conical medial portion extending between said lip around said central aperture and a connection band abutting an interior face of said perimeter wall;

an annular liner cartridge positioned on said shelf, a liner extending from said liner cartridge and through said central aperture of said shelf;

a sealing assembly coupled to said housing, said sealing assembly having a pair of opposed sealing members, said liner extending between said sealing members, said sealing members being movable to compress and seal said liner between said sealing members, said sealing members having complimentary shaped opposing faces to enhance engagement and sealing of said liner between said opposing faces of said sealing members, said sealing assembly further including a first pair of scissor arms pivotally coupled to each other, said sealing assembly further including a pair of opposed tracks positioned in said housing and coupled to said perimeter wall, said first pair of scissor arms having upper ends coupled to said sealing members whereby pivoting of said first pair of scissor arms moves said sealing members in said opposed tracks, each of said sealing members having end rollers engaged to said opposed tracks such that said sealing members extend between said opposed tracks;

a tray positioned in said housing beneath said shelf, said tray having an upwardly turned outer perimeter edge;

a biasing member positioned below said tray for urging said tray upwardly towards said shelf whereby said tray is configured to support garbage disposed into said liner through said central aperture of said shelf;

a first motor positioned in said housing;

a first screw rod positioned in said housing, said first screw rod having a threaded upper end and a lower end operationally engaged to said first motor to rotate said first screw rod;

a first threaded collar, said first threaded collar being engaged to said threaded upper end of said first screw rod and said first pair of scissor arms whereby rotation of said screw rod urges said first threaded collar to pivot said first pair of scissor arms;

a second motor positioned in said housing;

a second screw rod positioned in said housing, said second screw rod having a threaded upper end and a lower end operationally engaged to said second motor to rotate said second screw rod;

a second threaded collar, said second threaded collar being engaged to said threaded upper end of said second screw rod and a second pair of scissor arms whereby rotation of said screw rod urges said second threaded collar to pivot said second pair of scissor arms;

a door pivotally coupled to said perimeter wall;

said perimeter wall having an opening, said door selectively covering said opening;

a cover having a planar top portion and a sidewall extending from a perimeter edge of said top portion, said top portion having a central hole, wherein said hole is aligned with said central aperture when said cover is positioned on said housing such that said liner is configured for receiving refuse deposited into said liner through said hole and said central aperture;

a tongue extending from one of said sealing members; and a groove extending into another of said sealing members, said groove being complementary in shape to said tongue and positioned facing said tongue whereby said tongue is received in said groove when said sealing members are moved together to compress and seal said liner.

* * * * *